US005082555A

United States Patent [19]

Read

[11] Patent Number: 5,082,555

[45] Date of Patent: Jan. 21, 1992

[54] SOIL FEEDING APPARATUS AND METHOD

[75] Inventor: James L. Read, Cohasset, Mass.

[73] Assignee: The Read Corporation, Middleboro, Mass.

[21] Appl. No.: 470,619

[22] Filed: Jan. 26, 1990

[51] Int. Cl.[5] ..... B07B 1/00

[52] U.S. Cl. ..... 209/244; 209/246; 209/910; 222/166

[58] Field of Search ..... 209/244, 246, 243, 910, 209/315; 414/419, 421; 222/162, 164, 166, 644, 454

[56] References Cited

U.S. PATENT DOCUMENTS

| | | | |
|---|---|---|---|
| 2,487,505 | 11/1949 | Witter | 222/166 X |
| 2,615,567 | 10/1952 | Campbell | 209/910 X |
| 3,198,395 | 8/1965 | McKinney | 222/166 |
| 3,256,862 | 6/1966 | Patterson | 222/166 X |
| 4,197,194 | 4/1980 | Read | 209/235 |
| 4,237,000 | 12/1980 | Read et al. | 209/420 X |
| 4,256,572 | 3/1981 | Read | 209/420 X |
| 4,859,135 | 8/1989 | Neufeldt | 222/166 X |

FOREIGN PATENT DOCUMENTS

| | | | |
|---|---|---|---|
| 1220449 | 5/1960 | France | 222/166 |
| 1548591 | 12/1968 | France | 222/166 |
| 403828 | 10/1973 | U.S.S.R. | 222/166 |

*Primary Examiner*—Donald T. Hajec
*Attorney, Agent, or Firm*—Richard P. Crowley

[57] ABSTRACT

An improved soil feeder system in combination with a soil separating apparatus and method of controlling the feeding of soil material employing the soil feeder. The soil feeder apparatus including a hopper body having included walls and flat bottom surface to define a hopper space to receive soil material and characterized by an opening at one end for controlling the feeding of soil materials to be screened. The body includes a funnel shaped walls to direct the soil material inwardly into the hopper body, as hydraulic cylinder at the one end to tilt the hopper body between a soil receiving position and a tilted soil discharging position. The soil feeder apparatus includes a sensor for activating the and hydraulic cylinders and a timer to delay for a defined time the feeding cycle and to return the hopper body rapidly to the receiving position, and a bracket for attaching the soil feeder to a soil separator apparatus to that the soil separator may be quickly loaded and the rate of feeding of soil material to the soil separating apparatus can be controlled as desired by the user.

30 Claims, 4 Drawing Sheets

SOIL FEEDING APPARATUS AND METHOD

BACKGROUND OF THE INVENTION

In many soil separators used to screen out coarse material from finer soils, feeding of soil to be separated is accomplished by dumping the material from a shovel of an excavating vehicle onto a grate or screen of the soil separator.

Soil separators traditionally have employed an inclined screen having a high end and a low end onto which the soil to be separated by screening is loaded gradually such that the larger rocks and aggregate roll off the low end of the screen and finer materials pass downwardly through the screen at a gradual feeding rate to prevent clogging. Improved soil separators such as "Screen All" soil separators, a registered trademark of The Read Corporation, are disclosed in U.S. Pat. Nos. 4,197,194; 4,237,000 and 4,256,572 and are hereby incorporated herein by reference. These soil separators have a box like housing and in addition to an upper coarse mesh screen, employ two lower slanted screens connected to a vibrator for shaking soil material loaded on the upper screen and contained thereon for screening by side panels and a high end panel, the low end being open. The very coarse material loaded on the upper screen is screened out initially by the slanted upper coarse mesh screen, the large particles passing from the upper section of the screen downwardly along the slanted surface of the upper screen and rolling off the lower end to be collected. The less coarse material passes through the upper screen and encounters shaking action of the lower slanted screens which accelerate the process of separating permitting a faster rate of loading, with the finer materials passing downwardly to a segregated bin under the housing accessible for removable from the high end. In as much as the low end of the coarse screen is open for releasing coarse materials, it is not feasible to dump a large load on the slanted screen, as much of the fine material would pass off the lower end with the coarser material and become co-mingled with the coarse soils.

The loading and feeding of the soil separators may be done by a conveyor or input hoppers or more frequently by dumping soil material on to the top screen frequently positioned in a hopper from the shovel of an excavating type vehicle, like a front end loader. When an excavating vehicle, such as a pay loader, is employed it is necessary to feed the soil material at a controlled rate onto the upper inclined grate, the soil material being funneled onto the grate by upwardly inclined side panel sections, and the high end funnel surface which serve as a hopper. This feeding operation requires time and a certain degree of skill on the pay loader operator's part and therefore ties up the use of very expensive equipment at considerable cost and inconvenience.

It is therefore desirable to provide for an improved effective soil feeding mechanism, and to a soil feeding mechanism in combination with a soil separator to provide for controlled rate of loading and improved seperation of finer soils and to a method of feeding soils to be separated into a soil separator employing the improved soil feeding mechanism.

SUMMARY OF THE INVENTION

The present invention is directed to a soil feeder apparatus and to a soil feeder apparatus in combination with a soil separating apparatus and to a method of controlling the feeding of soil material employing the soil feeder apparatus of the invention.

The present invention comprises an improved soil feeder apparatus to be attached to a soil separating apparatus having a screen such as an angled screen, the soil feeder apparatus being positioned above the screen and adapted to feed soil material in a controlled manner into the funnel shaped intake of the soil separating apparatus. The control feeding is controlled by a hydraulic system which energizes a tilting means and optionally may be regulated by a timing device which sets the time period over which the soil material is to be separated determined by the degree of fineness of the separated material desired. The soil feeder apparatus includes a hopper body with a substantially flat bottom surface, a one end and an other end and side walls which define a space within the hopper body to receive soil material to be separated by the soil separator apparatus. The side walls each include an angled base surface extending outwardly and upwardly and including hinge members at the outer most extremities of two arms extending from the one end. The bottom surface has an opening at and adjacent the one end having a width generally of about six inches to about twenty four inches and extending substantially across the width of the hopper body from the angled base surface of one wall to the angled base surface of the other wall to permit soil material to pass at a controlled rate through the opening onto the input hopper mechanism to which the soil feeder apparatus is attached.

The hopper body comprises a pair of upwardly extending angled sides on opposite side walls and an upwardly extending angled transverse wall at the other end to funnel soil material downwardly and inwardly into the hopper body. The hopper body is pivotably mounted by hinge means on a bracket for attachment to the high end of a soil separating apparatus having an angled screen. A pair of fluid cylinders are connected between the hopper body and the mounting bracket means attached to each side of the housing of a soil separating apparatus for tilting and lowering the hopper body between a lower loading position resting on the top screen of a soil separator and an upper soil discharge position. During tilting of the hopper body the axis of rotation extends between a one upper hinge member and an other hinge member mounted on a pair of bracket means used for attachment to a soil separator.

A sensor with a time delay timer such as a photoelectric beam sensor is provided for attachment on the soil separating apparatus for example positioned to detect the approach of the front end loader with the soil material such as in between the two bracket means to sense the presence of the shovel of a pay loader, or soil excavating vehicle as the pay loader or vehicle approaches the soil separator to dump a load of soil. The photoelectric sensor is electrically connected to a hydraulic system having a timer control for activating the operating cycle of the tilting means for tilting and lowering the soil feeder.

The tilting means comprises a fluid cylinder such as a hydraulic cylinder connected to a hydraulic system and a valve means controlled by a timing device set to discharge fluid from the fluid cylinder at the completion of the soil discharge position to permit a rapid return of the hopper body to the general horizontal loading position. There also is provided a timing means comprising an electrical timing device to delay for a defined time period the activation of the means to tilt for a defined time period at an angle position wherein, as the hopper body is increasingly raised, the remaining material discharges at a faster rate and the opening is enlarged permitting larger rocks and debris previously prevented from passing to pass through the opening and to proceed down the inclined grate or large mesh screen to exit from the back of the soil separator for subsequent pickup. At the termination of the discharge cycle the fluid is withdrawn quickly from the cylinder by opening the valve means to return rapidly the hopper body to a generally horizontal position thereby providing automatically for effective and controlled feeding of the soil material to the soil separating apparatus.

The invention also includes a method of feeding in a controlled manner soil material, usually obtained from a gravel pit, from a soil feeder apparatus, more particularly a soil feeder apparatus integrated on the top of a soil separating apparatus, for example a "Screen All" soil separator. The method comprises discharging soil material into a feed hopper body normally located above the soil receiving portion, normally including an inclined screen, of a soil separator apparatus such as a "Screen All" soil separator, the hopper body characterized by an opening at a one end being hingeably in communication with a mounting means. The opening is normally closed when the hopper body is in the lower loading position, and located above the soil separator apparatus, for loading by a payloader type excavating vehicle. The method includes tilting the hopper body containing a load of soil material in a controlled gradual manner to an inclined soil discharging position wherein the soil material is emptied downwardly onto the inlet screen of the soil separator, so that as the hopper body moves between the soil feeding position to the inclined soil discharge position, the opening at one end being tilted from a closed position to a inclined soil discharging position gradually increases in width to permit the gradual increase in volume and size of the soil material to be discharged onto the soil apparatus over a regulated time period. For example, the opening may extend from the one end up to 25 percent of the length of the hopper body. Normally where finer screened material is desired, the rate of tilting and associated rate of discharge is slower. The cycle times for soil feeding are variable depending on the desires of the user, for example, the cycle time for loading the hopper body varies from 1 to 15 seconds, the cycle for tilting the hopper body is from 20 seconds to 5 minutes and the return time for the hopper body varies from 10 seconds to 2 minutes.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DESCRIPTION OF THE EMBODIMENTS

Figure 1:
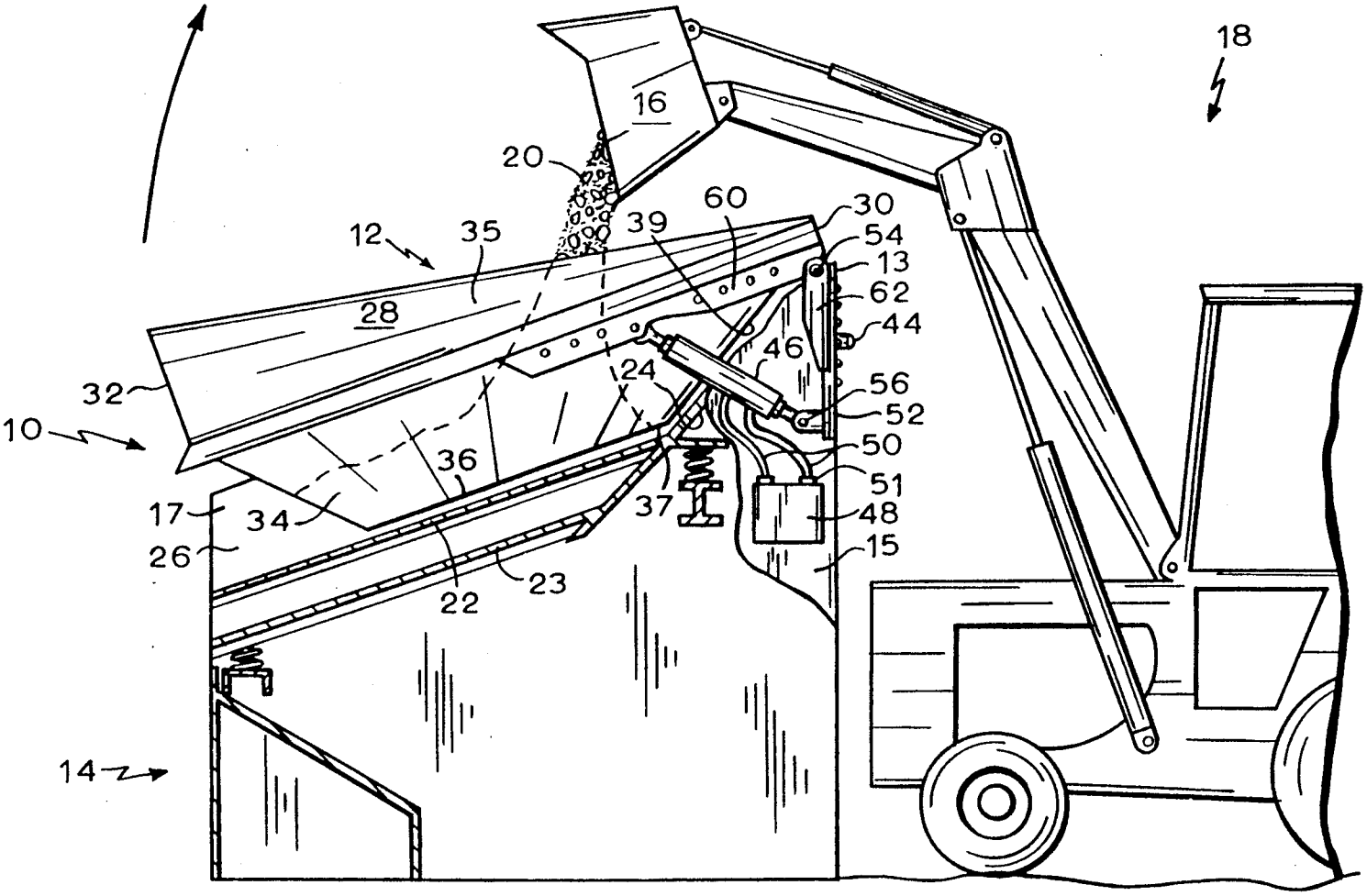
FIG. 1 is a cross-sectional elevational view of a soil feeding apparatus embodying the present invention shown attached to a soil separating apparatus shown soil material loading position.

With reference to the drawings, FIG. 1 shows in combination a soil feeding apparatus and soil separating apparatus 10 including a soil feeding apparatus 12 a soil separator 14 , illustrated as a "Screen All" separator, having a housing 15 with a high end 13 and a lower front end 17 shown with a soil excavating vehicle (payloader) 18 having a shovel 16 for depositing a load of soil material 20 in the soil feeder apparatus 12 shown in the lower loading position. The soil feeding apparatus 12 is positioned over a angled screen 22 being attached to housing 15 at the high end 13 by a pair of brackets 52, and comprises a hopper body 28 having a one end 30 and an other end 32, including a flat bottom surface 36 and a pair of side walls 34 with outwardly extending angled sides 35.

Figure 3:
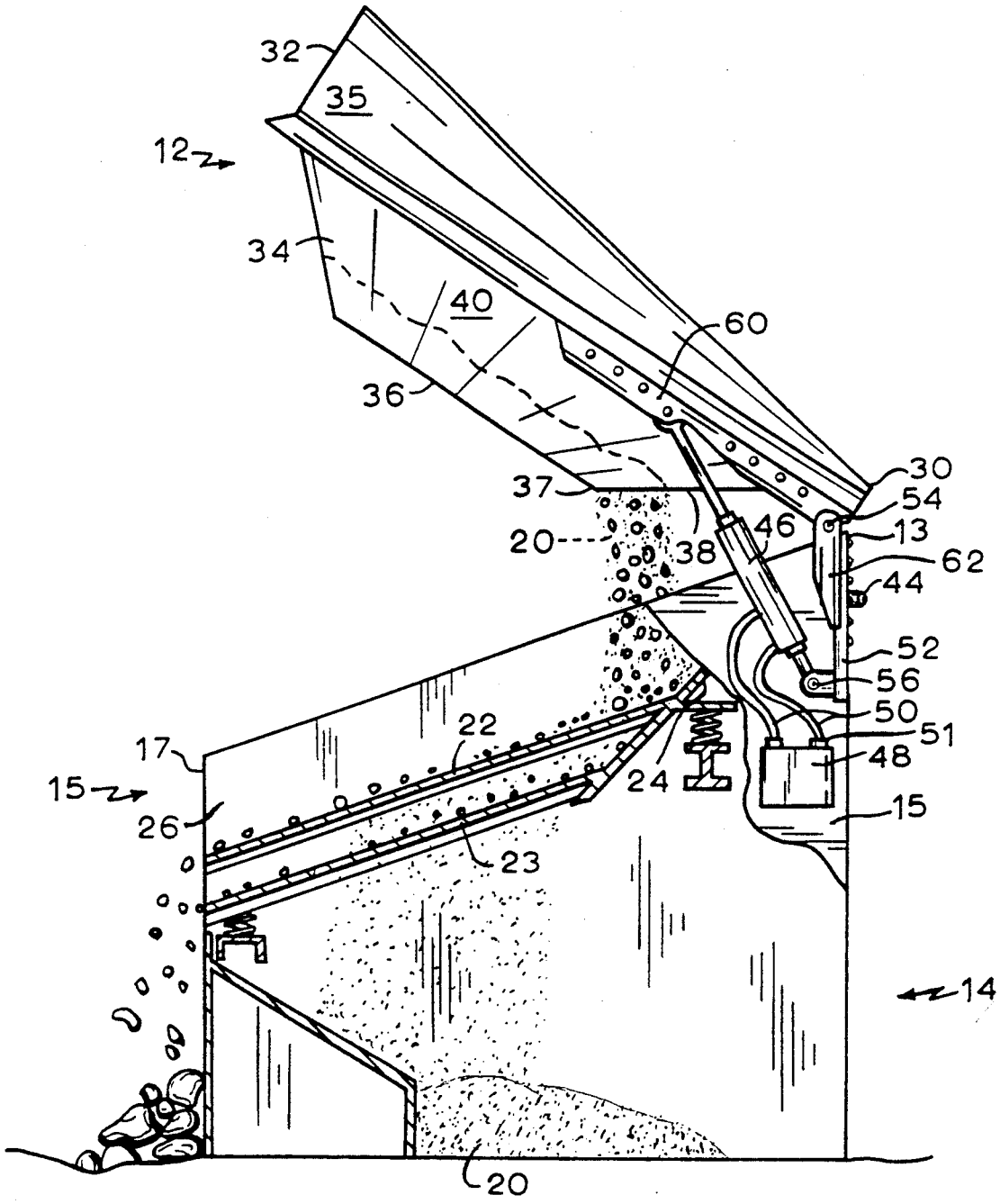
FIG. 3 is a cross-sectional elevational view of the soil feeder apparatus of FIG. 1 shown in the soil material discharging position with soil material being fed onto the upper shaker screen of the soil separating apparatus.

As shown in FIGS. 1 and 3, the housing 15 is provided with an upper angled screen 22 of coarse mesh and a lower angled screen 23 of finer mesh extending downwardly in parallel relationship from the high end 13 to the lower front end 17, a pair of side funnel surfaces 26 and a transverse funnel surface 24 extending there between. As shown in FIG. 3, soil material 20 is fed from the hopper body 28 when raised to the tilted discharge position by the action of hydraulic fluid cylinders 46 acting in response to hydraulic system means 48 being connected thereto by hydraulic lines 50 and having an electric timer 51.

Figure 2A:
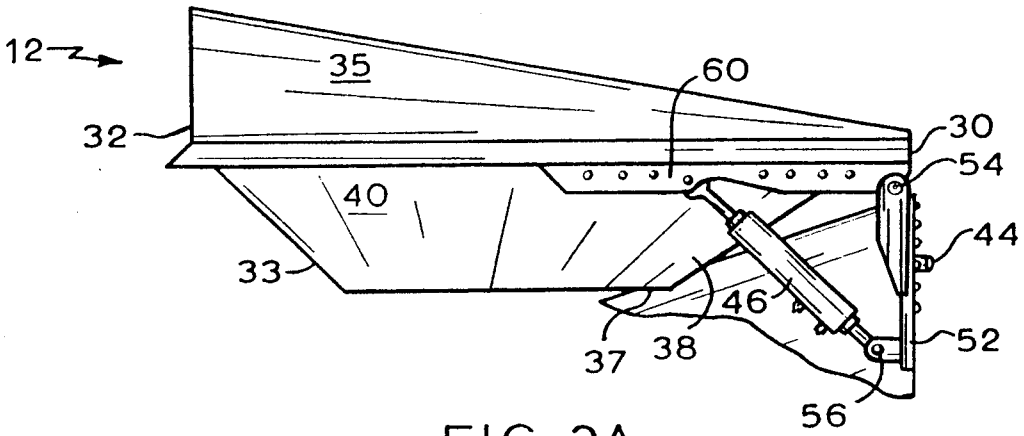
FIG. 2A is a side elevational view of the improved soil feeder apparatus of the invention as employed in FIG. 1.
Figure 2B:
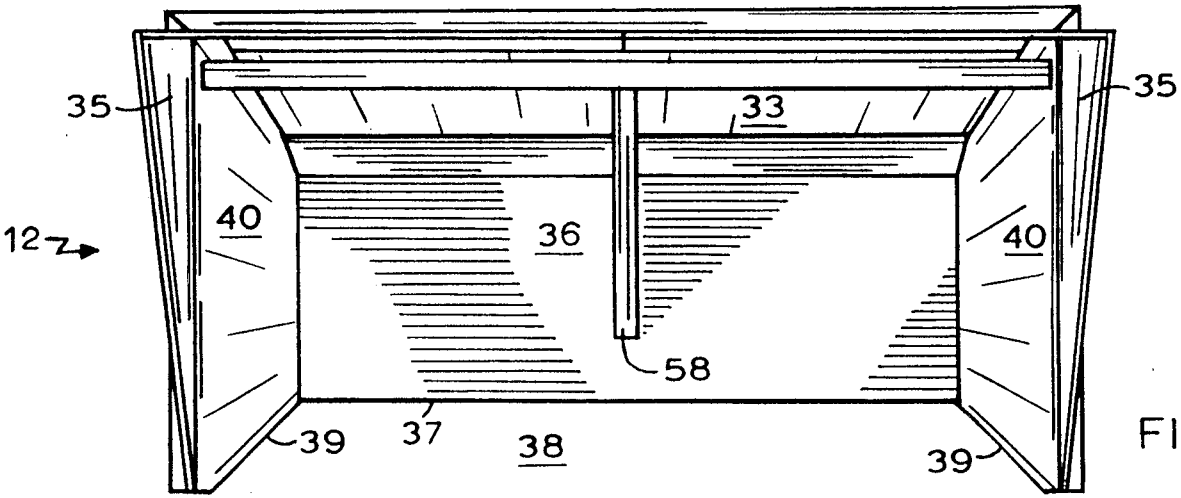
FIG. 2B is a top plan view of the improved soil feeding apparatus of the invention.

As shown in FIGS. 2A, and 2B, the soil feeding apparatus 12 further comprises a pair of hydraulic cylinders 46 each having a one end and an other end, the one end usually integrated with hydraulic cylinder or system of a "Screen All" soil separator, attached to a lower hinge means 56 attached to a vertically extending bracket 52 for mounting on the housing 15 and the other end attached to a longitudinally extending tilt bar 60. The one end of the tilt bar 60 is pivotably attached to bracket 62, part of bracket 52, secured to the soil separating apparatus to permit the hopper body 28 to pivot about on axis 54 between the generally horizontal soil material loading position (FIG. 1) and the inclined soil material discharging position (FIG. 3).

As shown in FIG. 1, soil 26 is dumped from the shovel 16 into the hopper body 28 and passes down the angled sides 35, the sidewalls 34, and the end wall 33 to accumulate on the bottom surface 36. Inasmuch as opening 38 defined by a pair of inclining side lips 39 and bottom lip 37 is closed by contact with the transverse funnel 24, soil is prevented from passing out of the hopper body.

Figure 4:
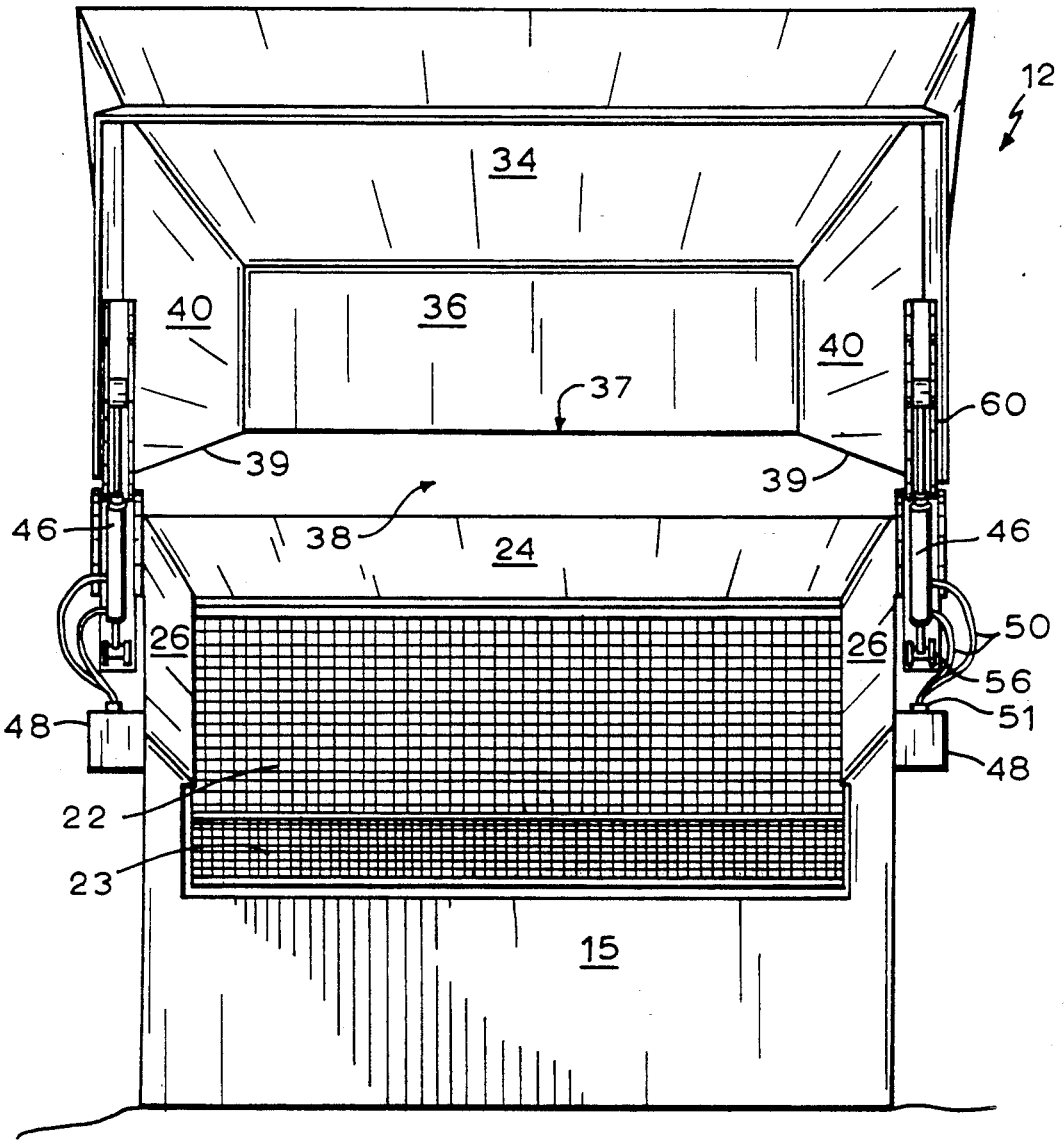
FIG. 4 is a front view of the soil feeding apparatus and soil separating apparatus of FIG. 3 and showing the soil feeding apparatus in the tilted feeding position.

As shown in FIG. 4, as the hopper body is tilted with the soil 20 being discharged onto the screen 22, the soil material 20 passes downwardly in sequence across screen 22 with finer and medium soils dropping through to lower screen 23 and finer soils dropping to the base of housing 15 for pickup via soil excavating front-end loader, larger rocks and material are screened out and pass out the front end 17 to accumulate in a pile for subsequent removal.

A photoelectric sensing means 44 is provided for attachment to the high end 13 of the housing 15 to sense the approaching presence of the shovel 16 of a payloader 18. The time delay means 51 is included in the hydraulic system 38 for delaying the actuation of the tilting cycle of the hopper body 40 until a full load of soil material 20 is dumped into the hopper body 40.

The cycle time for loading soil material from the payloader into the hopper body, for tilting the hopper body from the loading position upwardly to the discharge position and return of the hopper body to the loading position is variable depending on the fineness of the material to be separated, the slower the tilting rate the finer the screened material, for example the loading time varies between 1 and 15 seconds, the tilting time varies between 20 seconds and 5 minutes and the return time varies between 10 seconds and two minutes.

What is claimed is:

1. A soil feeder apparatus for use above an angled screen soil separating apparatus and adapted to feed soil material to be separated over a time period onto the angled screen of the soil separating apparatus for separation, which soil feeder apparatus comprises:

a) a hopper body having a one and other end and a bottom tray surface and a plurality of walls to define a space within the hopper body to receive soil material;

b) the bottom surface characterized by an opening extending substantially across the width of the hopper body at and adjacent to the one end to permit soil material to pass through the opening;

c) the hopper body having a pair of outwardly extending angled side means on opposite walls to direct soil material into the hopper body;

d) means to tilt the hopper body about an axis at the one end between a generally horizontal soil material loading position above the soil separating apparatus, and an angled soil material discharging position;

e) timing means to activate the means to tilt for a defined time period and to return rapidly the hopper body to the generally horizontal, soil material loading position, thereby providing automatically for the effective and controlled feeding of the soil material to the soil separating apparatus wherein the opening is exposed to discharge soil onto the angled screen of the soil separating apparatus, the timing means activating the time period for movement of the hopper body between a soil material loading position and a soil material discharging position and a return to the soil material loading position and;

f) a bracket means to mount the hopper body on a soil separating apparatus to permit the hopper body to move between a soil material loading position wherein the opening is adapted to be placed adjacent the soil separator apparatus to close the opening and on tilting to a soil material discharging position.

2. The soil feeder apparatus of claim 1 wherein the hopper body has a higher wall at the other end than at the one end and angled side walls to define a generally trapezoidal hopper space.

3. The soil feeder apparatus of claim 1 wherein the said opening extends from the one end of a flat surface bottom up to 25 percent of the length from the one to other end of the hopper body.

4. The soil feeder apparatus of claim 1 wherein the means to tilt comprises a fluid cylinder means.

5. The soil feeder apparatus of claim 4 which includes a pair of spaced apart hydraulic cylinders adapted to be secured at one end of the cylinders to the soil separating apparatus and secured to opposite sides of the one end of the hopper body adjacent the other end of the cylinders.

6. The soil feeder apparatus of claim 1 which includes a sensing means for sensing the presence of a shovel of an excavating vehicle for discharging soil material in the hopper space and which comprises a light beam sensing means to project a light beam from the one end of the hopper body.

7. The soil feeder apparatus of claim 1 wherein the timing means comprising an electrical timing device and provides a variable delay of up to about 5 seconds after soil material is discharged to activate the means to tilt, and provides a variable delay of up to about 5 minutes for the activating of the means to tilt.

8. The soil feeder apparatus of claim 1 wherein the means to tilt comprises a fluid cylinder means and includes valve means controlled by the timing means to discharge fluid from the fluid cylinder means at the end of the soil material discharge position to provide rapid return of the hopper body to the generally horizontal soil material position.

9. In combination, the soil feeder apparatus of claim 1 positioned above and designed to feed soil material into an angled screen soil separating apparatus with the high end of the angled screen below the said opening of the hopper body and the low end of the angled screen below the other end.

10. The soil feeder apparatus of claim 1 wherein the bracket means comprises an upper hinge means for engaging the hopper body and a lower hinge means to engage the means to tilt.

11. A method of feeding in a controlled manner soil material from a soil feeder apparatus into a soil separating apparatus which method comprises:

a) discharging soil material into a soil receiving feed hopper body of a soil feeding apparatus from a soil carrying vehicle, the hopper body characterized by an opening at the one end, which opening is closed in the soil material loading position; the feed hopper in a soil material loading position above the soil separator apparatus with the opening in a closed position abutting a surface of the soil separating apparatus;

b) sensing a soil carrying vehicle;

c) tilting the hopper body containing the soil material in a controlled gradual manner to an inclined soil material discharging position over a defined time period after sensing so that on movement between the soil feeding and inclined soil discharging position, the closed opening at one end is gradually increased by the tilting to increase the width of the opening between the one end of the hopper body and the surface of the soil separating apparatus to permit the gradual increase in the soil material to be discharged onto the soil separator apparatus over a regulated time period, thereby permitting the controlled discharge of the soil material over a time period into the soil separator apparatus.

12. The soil feeder method of claim 11 which includes rapidly returning the feed hopper body to the soil material loading position after the discharge of the soil material into the soil separating apparatus.

13. The soil feeder method of claim 11 wherein the cycle times for loading, tilting and return varies for loading the hopper body from 1 to 15 seconds, tilting the hopper body from 20 seconds to 5 minutes and return of the hopper body to the soil material loading position from 10 seconds to 2 minutes.

14. A soil feeder apparatus adapted to feed soil material to be separated onto an upper screen means of a soil separating apparatus by a soil carrying vehicle, which soil feeder apparatus comprises:

a) a hopper body having a one and other end and a bottom tray surface and a pair of side walls to define a soil material space within the hopper body;

b) the bottom surface characterized by an opening extending substantially across the width of the hopper body and adjacent the one end to permit soil material to pass through the opening and onto the upper screen means of a soil separating apparatus;

c) means to mount the hopper body on a soil separating apparatus and to permit the hopper body to move between a soil material loading position to receive soil material to be separated with the hopper body generally horizontally positioned above the soil separating apparatus and the said opening closed by abutting against a surface of the soil separating apparatus and a soil material discharge position to discharge soil material through the opening when the hopper body is tilted in an upwardly inclined position, and the soil material permitted to be discharged through the opening between the one end of the hopper body and the surface of the soil separating apparatus;

d) means to tilt the hopper body about an axis at one end between the soil material loading position and the soil material discharging position; and e) timing means to activate the means to tilt and to provide for a defined time period for the controlled timed movement of the hopper body in a cycle from the soil material loading position to the soil material discharging position and return to the soil material loading position.

15. The soil feeder apparatus of claim 14 which includes a sensing means connected to the timing means to sense the presence of a soil carrying vehicle.

16. The soil feeder apparatus of claim 14 wherein the sensing means comprises a photoelectric beam sensor electrically connected to a timing means which comprises a time delay timer.

17. The soil feeder apparatus of claim 16 wherein the means to mount comprises a hinge means on a bracket means, the bracket means adapted to be secured to the soil separating apparatus at the one end and the hopper body pivotably mounted at the one end to the hinge means.

18. The soil feeder apparatus of claim 14 wherein the hopper body comprises upwardly angled side walls and an upwardly angled transverse wall at the other end while the one end comprises said opening.

19. The soil feeder apparatus of claim 14 wherein the means to tilt comprises hydraulic means which include a pair of spaced apart hydraulic cylinders secured to the one end of the hopper body and to the soil separating apparatus.

20. The soil feeder apparatus of claim 19 wherein the hydraulic means includes a hydraulic valve means controlled by the timing means to permit the discharge of fluid from the hydraulic cylinders so as to return rapidly the hopper body from the soil material discharging position to the soil material loading position.

21. In combination, the soil feeder apparatus of claim 19 positioned above a soil separating apparatus having an upper angled screen means onto which upper screen means soil material is discharged from the soil feed apparatus in the movement of the hopper body from the soil material loading position to the soil material discharging position.

22. The combination of claim 21 wherein the soil separating apparatus includes a pair of spaced apart, vibratable, angled screen means with the higher end of the angled screen means adjacent the one end of the hopper body of the soil feeder apparatus.

23. The combination of claim 21 wherein the soil separating apparatus includes a transverse funnel surface which generally abuts the said opening of the hopper body to close said opening of the hopper body.

24. A method of feeding soil material to be separated from a soil feeder apparatus into a soil separating apparatus having an upper screen means, which method comprises:

a) providing a soil feeding apparatus having a hopper body with a one and other end a space to receive soil material to be separated and characterized by an opening at the one end which opening extends transversely across the hopper body and generally abuts a surface of a soil separating apparatus positioned beneath the soil feeding apparatus to close the opening and place the hopper body in a soil material loading position to receive soil material from a soil discharging vehicle;

b) loading soil material from a soil discharging vehicle into the space of the hopper body in the soil material loading position;

c) tilting the hopper body with the soil material therein about an axis at one end into an upwardly incline, soil material discharging position to open the opening and to permit the soil material to be discharged through the said opening onto the upper screen means of the soil separating apparatus for separation, the tilting of the hopper body providing for the gradual increase in said opening width until; and d) returning the hopper body after a defined time period to the soil material loading position.

25. The method of claim 24 wherein the loading of the soil material ranges from about 1 to 15 seconds.

26. The method of claim 24 wherein the tilting of the hopper body ranges from about 20 seconds to 5 minutes.

27. The method of claim 24 wherein the return of the hopper body ranges from about 10 seconds to 2 minutes.

28. The method of claim 24 which includes sensing a soil carrying vehicle to activate the timed movement of the hopper body.

29. The method of claim 24 which includes abutting a generally angled, transverse side funnel surface of the soil separating apparatus against the opening of the hopper body to close the opening to place the hopper body in the soil material loading position.

30. The method of claim 24 which includes tilting the hopper body employing hydraulic cylinders and rapidly discharging hydraulic fluid from the cylinders after a time period to return the hopper body to the soil material loading position.

* * * * *